US005421533A

United States Patent [19]

Scott et al.

[11] Patent Number: 5,421,533

[45] Date of Patent: Jun. 6, 1995

[54] HOSE WINDING APPARATUS AND METHOD

[75] Inventors: Blayney J. Scott; Siegfried Bulling, both of Victoria; Barry G. Gilbert, Sidney; Charles E. Rive, North Vancouver, all of Canada

[73] Assignee: Scott Plastics Ltd., Victoria, Canada

[21] Appl. No.: 145,046

[22] Filed: Nov. 3, 1993

Related U.S. Application Data

[63] Continuation of Ser. No. 830,870, Feb. 4, 1992, abandoned.

[51] Int. Cl.[6] ..... B65H 75/38

[52] U.S. Cl. ..... 242/405.3; 53/118; 53/399; 53/430; 53/592; 242/597.4

[58] Field of Search ..... 242/86, 96, 396.5, 397.1, 242/405.3, 597.4; 137/355.19, 355.26, 355.16; 53/585, 592, 430, 399, 118, 116

[56] References Cited

U.S. PATENT DOCUMENTS

| | | | |
|---|---|---|---|
| D. 299,618 | 1/1989 | Drought et al. | 242/405.3 |
| 2,197,767 | 4/1940 | Neale | 242/86 |
| 3,168,260 | 2/1965 | Kittleson | 242/86 |
| 3,195,444 | 7/1965 | McLean | 53/592 |
| 3,393,633 | 7/1966 | Hoffman et al. | 53/399 |
| 3,974,762 | 8/1976 | Kita et al. | 53/592 |
| 3,975,883 | 8/1976 | Besnyo et al. | 53/430 |
| 4,220,293 | 9/1980 | Gename | 242/405.3 |
| 4,251,038 | 2/1981 | Ganame | 242/86 |
| 4,306,688 | 12/1981 | Hechler | 242/86 |
| 4,506,698 | 3/1985 | Garcia et al. | 242/86 |
| 4,586,676 | 5/1986 | Johnson et al. | 242/86 |
| 4,601,155 | 7/1986 | Lewis | 53/399 |
| 4,732,345 | 3/1988 | Golden | 242/86 |
| 5,014,925 | 5/1991 | Cump | 242/405.3 |

*Primary Examiner*—Daniel P. Stodola
*Assistant Examiner*—Eileen A. Dunn
*Attorney, Agent, or Firm*—Bull, Housser & Tupper

[57] ABSTRACT

Hose winding apparatus comprises a first portion having a body and a first handle extending therefrom, and a second portion having a reel portion and a second handle cooperating with the reel portion. Each portion has reel journalling structure for journalling the first and second portions for relative rotation about a reel axis. A latching structure releasably latches together the first and second portions to permit the said relative rotation without unintentional separation of the first and second portions. A wound-up hose coil is retained tightly wound-up after the removal from the reel portion by fitting a resilient band to extend across opposite locations of the reel portion, and winding the hose onto the reel portion with a first face of the wound-up hose being adjacent a first length of the band. This is followed by drawing and stretching a second length of the band from the reel, and positioning the second length closely adjacent a second face of the coil. This permits the wound-up coil to be drawn from the reel portion along an axis of rotation thereof, without unwinding, for ease of storage and transportation, and to permit re-use of the apparatus.

21 Claims, 6 Drawing Sheets

HOSE WINDING APPARATUS AND METHOD

This application is a continuation of application Ser. No. 07/830,870, filed 4 Feb. 1992, now abandoned.

BACKGROUND OF THE INVENTION

The invention relates to a hose winding apparatus and method, particularly adapted for winding relative light weight hoses, for example as used in forest fire fighting.

Hoses are used for many applications, from relatively light duty applications such as watering the garden using hoses having about one half inch diameter bores, to heavy duty applications for industrial fire fighting applications as used by mechanised municipal fire fighters, which hoses are typically of two to three inches in diameter. Commonly, light duty hoses are fabricated from a relatively stiff plastic which does not flatten easily, and winding up long lengths of such hose for storage or transportation purposes correspondingly requires relatively large reels. The heavy duty industrial fire fighting hoses are fabricated from a woven or braided material, which can be flattened for winding and storage. However, a hose of this type is relatively heavy, and only short lengths can be handled by one person, which are unwound and connected together as needed.

The present invention is particularly adapted for medium duty hoses, which are commonly made from woven or braided fabric and thus can be flattened, and have a bore of approximately one half inch to one inch. Such hoses are commonly used for wilderness forest fire fighting, where long lengths of hoses are required to be carried manually by persons on foot. Such hoses must be relatively light, and yet sufficiently strong to withstand rough usage and relatively high pressure for delivery to remote locations. The hoses are commonly provided in lengths of between 50 and 100 feet, with threaded couplings at opposite ends for interconnecting to form long lengths of hose, which one commonly several hundred feet long, and sometimes over a thousand feet long.

Commonly, after fighting a fire, the forest is littered with thousands of feet of interconnected hoses, which require retrieval, draining, and rewinding for removal for future use. The retrieval of the thousands of feet of hoses is time consuming, and commonly the resulting coils are poorly wound due to the haste which is necessary to reduce labour costs. If the hoses are to be removed by helicopter, due to space and weight restrictions in helicopters, it is necessary that the hoses be drained and wound as tightly as possible, and do not unwind when stored in the helicopter.

Many devices for winding and storing hoses have been devised, but none of these would be ideally suited for winding and storing medium duty hoses as used in forest fire fighting as discussed above. Devices that are designed to be attached to a structure, for example the side of a house, are not sufficiently portable for the intended use. Also, in many devices, the reel is used for storage, i.e. when the hose has been wound onto the reel, that reel is now fully utilized, and cannot be used to wind any other hoses. One such device is found in U.S. Pat. No. 4,586,676 issued to Johnson et al, which discloses a garden hose storage apparatus in which a hose is wound onto a reel, after first passing through hose guide means. When a long length of hose has been wound onto the Johnson reel, the reel is full and the hose cannot be removed therefrom without unwinding, and thus additional hoses cannot be wound thereon. Furthermore, this reel is for a relatively stiff garden hose which does not flatten appreciably as it is wound.

U.S. Pat. No. 4,306,688 issued to Hechler IV, discloses a relatively compact hose reel assembly for winding and storing hoses which can be flattened. The hose passes through hose guides prior to being wound on the reel, but when the reel contains the hose, the assembly cannot then be used to wind other hoses.

U.S. Pat. No. 4,732,345 issued to Golden, discloses a hose reel which permits hoses to be reeled in sections and removed from the apparatus in the rolled condition for storage, testing, etc. This is for use with hoses which can be flattened, as for example fire hoses or for more rigid types of hoses. This device appears to be a relatively heavy duty apparatus which is mounted on a stand and the wound hose is retained between hose guide plates removably attached to a rotatable sleeve.

U.S. Pat. No. 4,251,038 issued to Gename, discloses a portable hose reel winding apparatus which is used for winding hoses which can be flattened prior to winding on the reel. The hose is wound onto a reel having a pair of integral side faces which retain the wound-up hose therebetween, the wound-up coil and reel being removable from the winding apparatus. While this provides some advantages to the present invention, each length of a hose to be wound would require a separate reel for winding and storage thereon, which would be awkward for use in a forest fire situation due to the large number of sections of hose that are used in such operations, and the corresponding large number of separate reels.

From the above it can be seen that there is no easily portable apparatus known to the inventor which facilitates winding a long length of flexible hose into a tight coil, which can then be removed as a tight coil from the apparatus, permitting re-use of the apparatus.

SUMMARY OF THE INVENTION

The invention reduces some of the difficulties and disadvantages of the prior art by providing a hose winding apparatus and method which permits a length of hose to be flattened and wound to form a tightly wound-up hose coil. The hose coil can then be removed from the apparatus and maintained in a tightly wound state using only a resilient band, for example, a heavy duty rubber band. After removing the coil from the apparatus, the apparatus is then free to wind other lengths of hose. The apparatus is relatively lightweight, and permits rapid attachment of one end of a length of hose prior to winding, and also strips the hose, i.e. it squeezes air or water from the hose, and aligns the hose prior to winding to ensure that the hose is flattened and in a tightly wound state when removed from the apparatus.

A hose winding apparatus according to the invention comprises first and second portions, latching means and a coil removal means. The first portion has a body, a first handle for holding the body, and first reel journalling means. The second portion has a reel portion, a second handle cooperating with the reel portion and second reel journalling means complementary to the first reel journalling means for journalling the reel portions for rotation about a reel axis to wind the hose thereon. The journalling means also permits easy axial separation of the first and second portions along the reel axis. The latching means are for releasably latching together the first and second reel journalling means to permit relative rotation therebetween without inadvertent separation of the first and second portions. The coil removal means is for permitting a wound-up coil of hose to be removed from the apparatus. The apparatus further comprises a hose preparing means for preparing, in sequence, adjacent portions of the hose for winding onto the reel, prior to winding the hose onto the reel, the hose preparing means cooperating with the first portion. The apparatus also comprises a hose end retaining means for releasably retaining an end of the hose on the reel, the hose end retaining means cooperating with the second portion. The apparatus further comprises a wound hose coil retaining means for retaining the hose coil in a wound-up state when released from the apparatus. The wound hose retaining means comprises a resilient band having a size to fit across opposite locations of the reel portion, the reel portion being a generally flat plate with a circular rim centred on the reel axis, the rim having a pair of generally diametrically spaced recesses to receive the resilient band therein.

A method of removing and retaining tightly wound-up a coil of hose from a reel according to the invention includes the steps of:

- fitting a resilient band to extend across generally opposite locations of a reel portion,
- winding the hose onto the reel portion to form a hose coil of tightly wound-up hose having opposite first and second faces, the first face being adjacent a first length of the band,
- drawing and stretching a second length of the band from the reel, and positioning the second length closely against second face of the hose coil, and generally diametrically opposite sides of the coil are retained tightly by the band,
- drawing the wound-up hose coil from the reel portion along an axis of rotation of the reel portion, the hose coil being retained wound-up by the stretched resilient band.

The method is further characterized by, subsequent to winding the hose onto the reel, exposing the second face of the wound-up hose to receive the second length of the band.

A detailed disclosure following, related to drawings, describes preferred method and apparatus according to the invention, which is capable of expression in method and apparatus other than those particularly described and illustrated.

DETAILED DISCLOSURE

FIGS. 1 through 4

Figure 1:
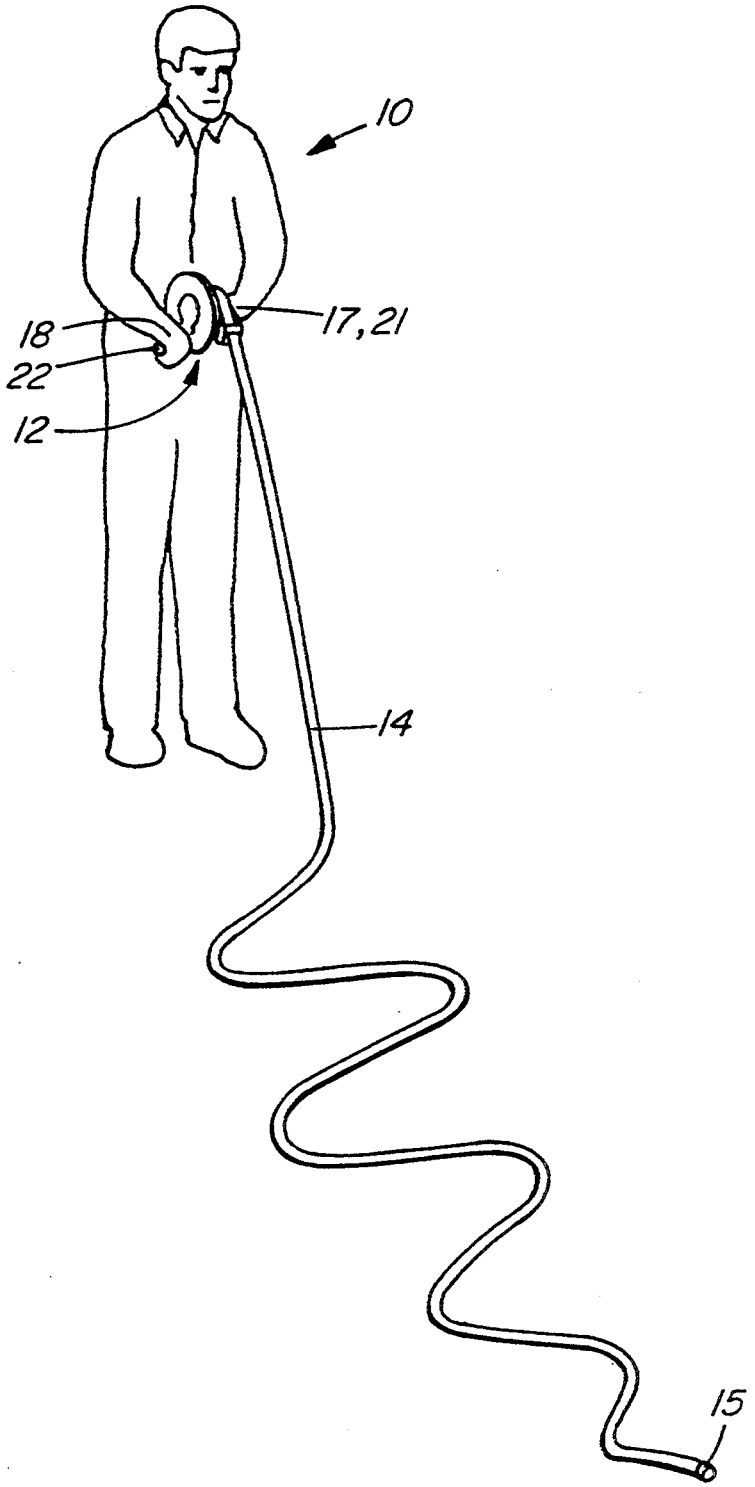
FIG. 1 shows an operator winding a length of hose into a coil using an apparatus according to the invention.

In FIG. 1, an operator 10 is holding a reel apparatus 12 according to the invention to wind in a length of hose 14, the hose having a hose coupling 15 at an outer end thereof. A similar but opposite hose coupling at an inner end of the hose is releasably connected to the apparatus 12, as will be described with reference to FIGS. 6 and 7. Left and right hands 17 and 18 of the operator grip first and second handles 21 and 22 respectively for reeling in the hose 14.

Figure 2:
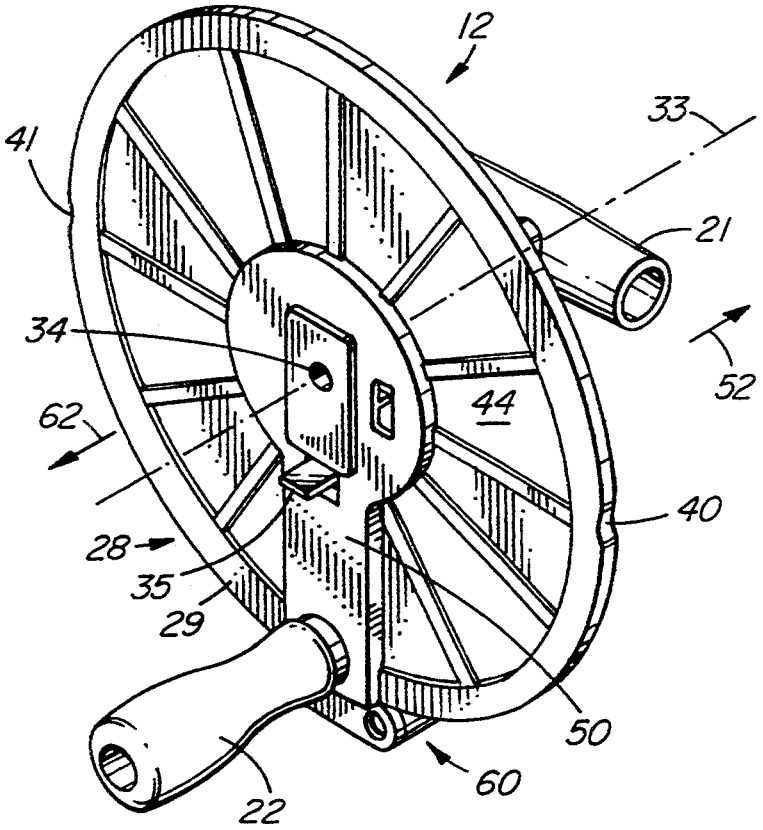
FIG. 2 is a perspective of the apparatus from one side thereof.
Figure 3:
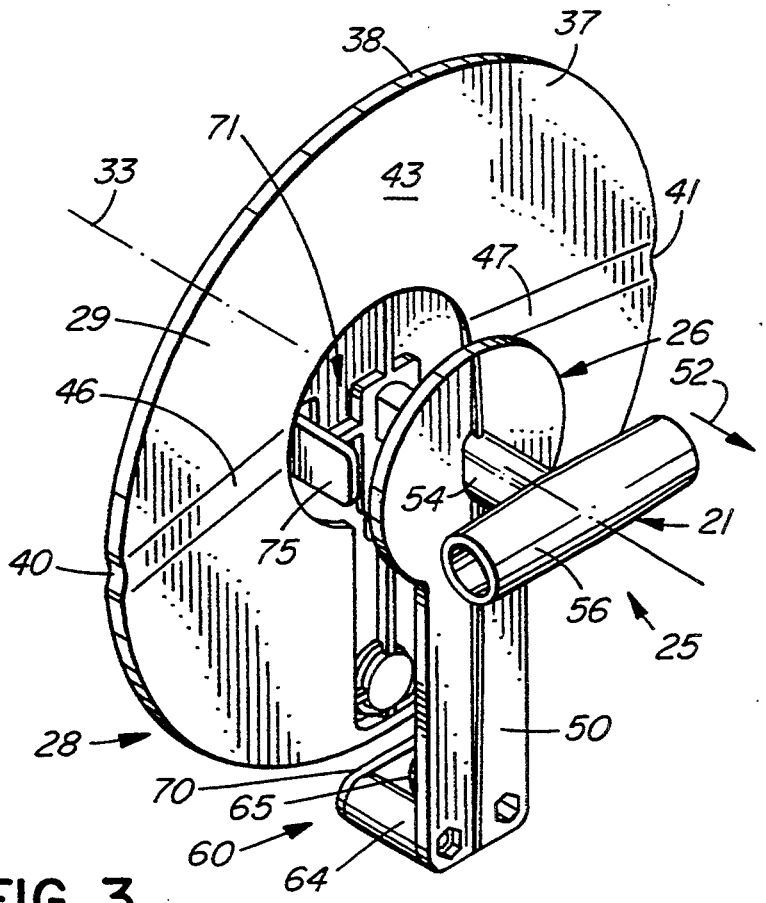
FIG. 3 is a perspective of the apparatus from an opposite side thereof.
Figure 4:
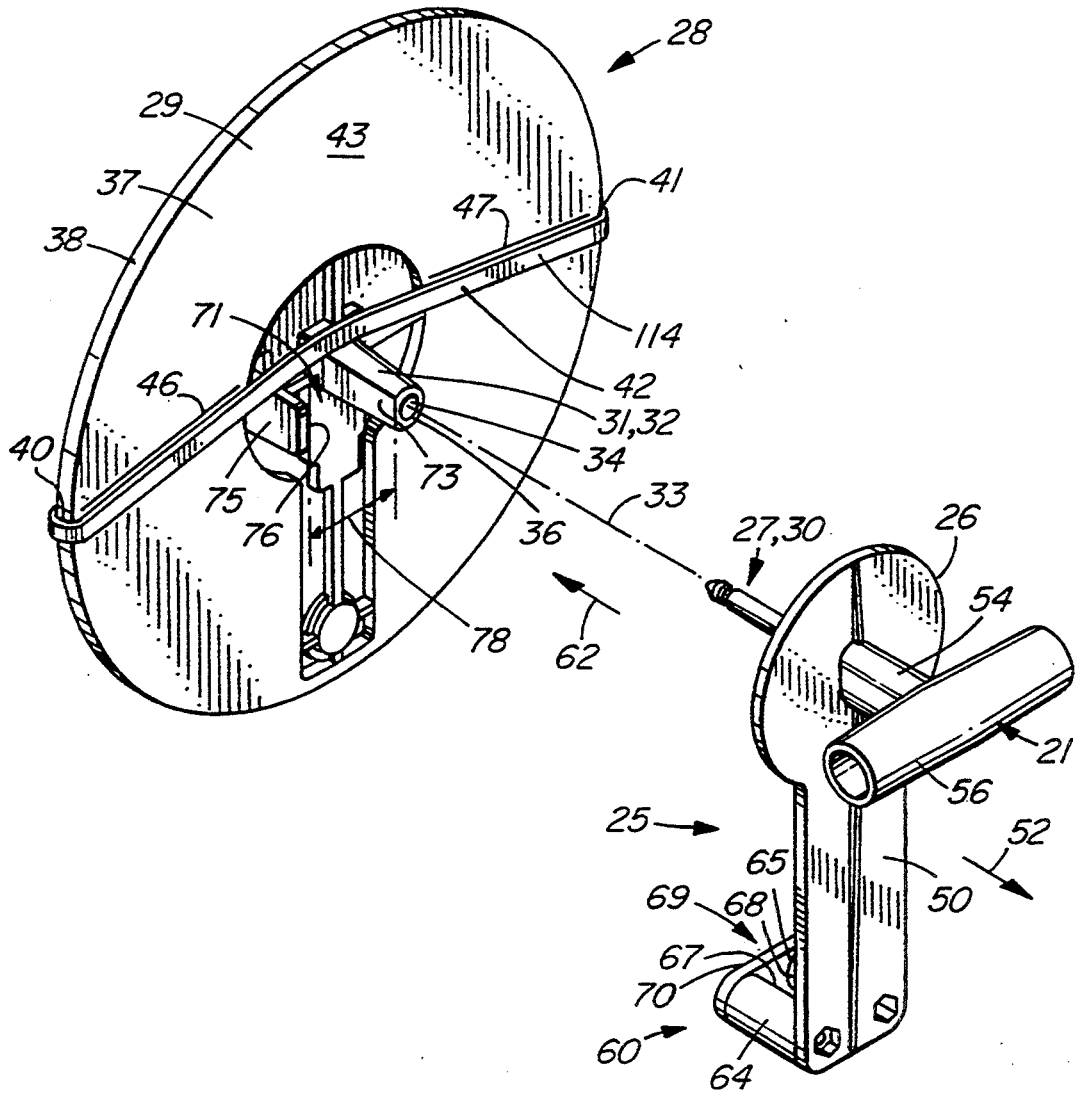
FIG. 4 is an exploded perspective showing two main portions of the apparatus separated, which is necessary to insert or remove a hose therefrom, with a rubber band attached to one portion thereof.

Referring mainly to FIGS. 2 through 4, the apparatus 12 comprises a first portion 25 having a body 26, the first handle 21, and a spindle 30 of a first reel journalling means 27, seen in FIG. 4. The apparatus also comprises a second portion 28 having a reel portion 29, the second handle 22 journalled to the reel portion, and a column 32 of a second reel journalling means 31. The column 32 has an opening 34 to freely journal the spindle 30 therein and an outer end 36 adapted to contact the body 26 when assembled. Thus, the second reel journalling means is complementary to the first reel journalling means and is for journalling the reel portion 29 for rotation about a reel axis 33 with respect to the body 26. The journalling means also permits easy axial separation of the first and second portions along the reel axis. The apparatus further comprises a latching means 35 (FIG. 2) for releasably latching together the first and second reel journalling means to permit selective rotation therebetween without inadvertent separation of the first and second portions, as will be described with reference to FIG. 5.

The reel portion 29 comprises a single generally flat reel plate 37 with a circular rim 38 centred on the reel axis 33, the rim having a pair of generally diametrically spaced recesses 40 and 41 (FIG. 3), to retain a rubber band 42 (FIG. 4) for specific purposes as will be described with reference to FIGS. 8 through 10. The plate has parallel inner and outer faces 43 and 44, the inner face being provided with a pair of band guiding marks 46 and 47 which extend from a position closely adjacent the center of the reel, i.e. the column 32, to the recesses 40 and 41 respectively for guiding location of the band 42 as will be described.

As seen in FIGS. 3 and 4, the body 26 has a guide arm 50 extending radially therefrom a distance greater than radius of the reel portion. The first handle 21 extends in a first direction from the body 26 and the guide arm 50, as shown by an arrow 52. The handle has a root portion 54 disposed about the reel axis 33, and a grip portion 56 disposed at right angles thereto, so as to form a generally T-shaped handle. The grip portion 56 is most conveniently gripped by the hand with the first and second fingers on one side of the root portion, and the third and fourth fingers on the opposite side, the thumb passing around the grip portion to fully enclose it. This manner of gripping enables an operator to hold the first portion 25 easily and firmly, and to apply torque to the reel through the second handle 22 as will be described. An easily applied but firm grip is particularly important, as many operators will be wearing heavy work gloves for using this device.

Figure 6:
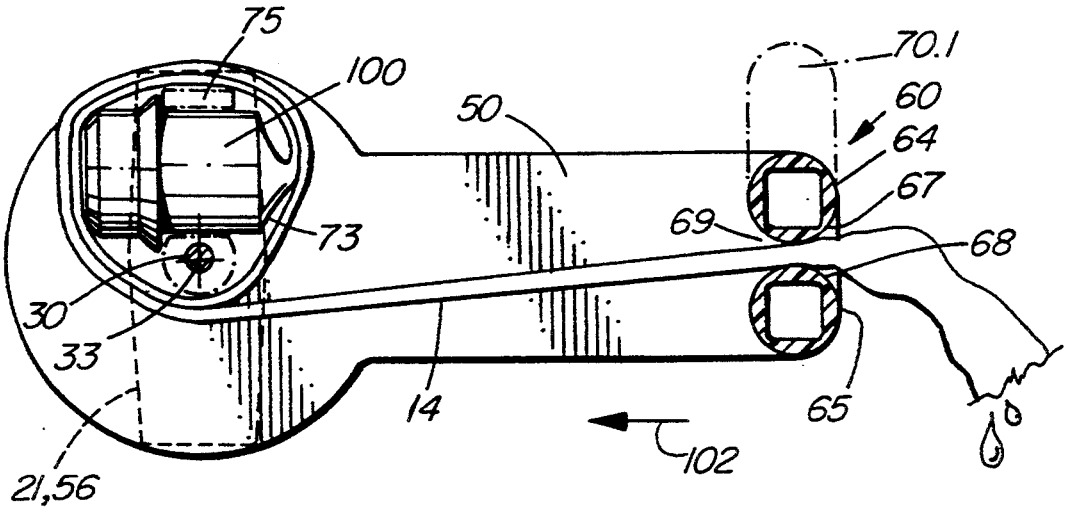
FIG. 6 is a simplified longitudinal section through a guide portion of the apparatus showing a portion of the hose being stripped or squeezed prior to winding onto the reel.

A hose guide means 60 extends from an outer end of the guide arm in a second direction, shown as arrow 62, which is opposite to the first direction of the arrow 52 with respect to the body 26. The hose guide means comprises a pair of spaced apart guide members 64 and 65, the guide members extending from the arm as shown and providing a pair of oppositely disposed guide surfaces 67 and 68 respectively, as best seen in FIG. 6. The guide surfaces face each other and define a guide slot 69 therebetween, the slot 69 being generally parallel to the reel axis 33 to serve to align and strip the hose for winding onto the reel. A guide retaining bar 70 extends between outer ends of the guide member 64 and 65 and, as will be described, is releasably attached thereto.

The reel portion 29 has a hose end retaining means 71 comprising the column 32 of the second reel journalling means, and a flat plate like projection 75. Both the column and the projection 75 extend from the inner face 43 of the plate 37 towards the body 26 when assembled. The column 32 has a flat surface 73 disposed oppositely to, and parallel to, a flat inner surface 76 of the projection 75. The surface 76 is spaced from the flat surface 73 by a spacing 78 (also in FIG. 7) to receive an inner coupling at the inner end of the hose, as will be described in greater detail with reference to FIGS. 6 and 7. The oppositely facing surfaces 73 and 76 of the column 32 and projection 75 serve as the hose end retaining means 71 for releasably retaining a coupling provided adjacent an end of the hose. It can be seen that the hose end retaining means 71 cooperates with the second portion and provides an anchor for an inner end of the hose to permit the hose to be wound tightly upon the reel. The hose end retaining means thus comprises an inner portion, namely the column 32, and an outer portion, namely the projection 75, which have oppositely disposed faces spaced apart to receive the hose coupling therebetween. It is noted that the hose end retaining means 71 extends from the inner face 43 of the reel portion 29 in the first direction per the arrow 52, whereas the second handle 22 extends from the outer face 44 of the reel portion in the second direction, namely in direction of the arrow 62 as seen in FIG. 2.

FIG. 5

Figure 5:
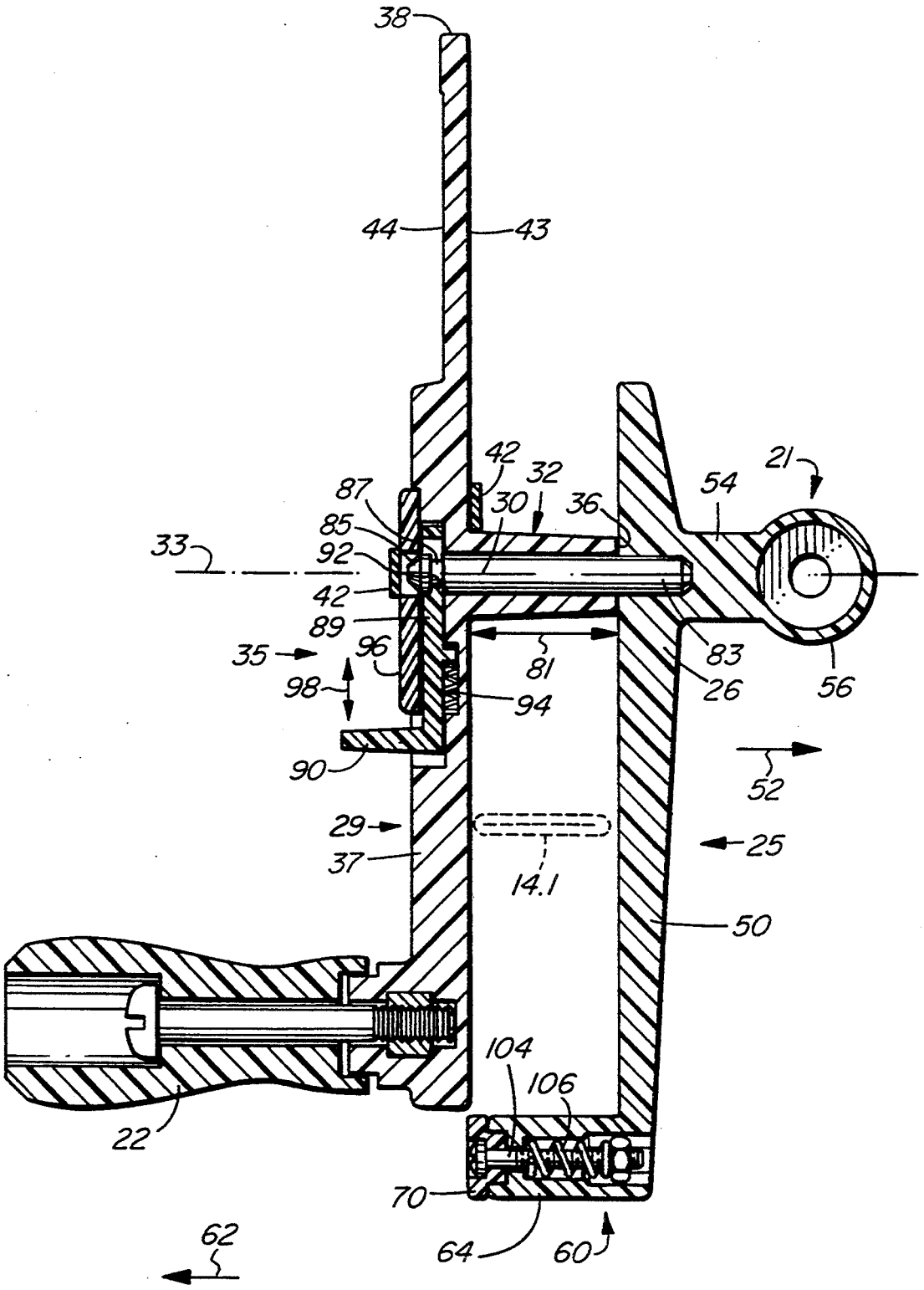
FIG. 5 is a simplified cross-section of an apparatus, the section being taken on a diametrical plane of a reel portion of the apparatus, and along a center line of a guide portion of the apparatus.

The column 32 has a length 81 which defines space between the inner face 43 of the reel portion 29 and the end 36 of the column. When the apparatus is assembled as shown in FIG. 5, the outer end 36 contacts an inner face of the first portion 25 and controls minimum separation between the first portion and the reel portion to provide a space to receive the hose as will be described. Thus the column 32 serves a spacing means to space the reel plate 29 axially from the body 26 sufficiently to receive the wound up hose therebetween. It can be seen that the spacing means extend axially from the plate to the spacer outer end, namely the end 36, which contacts the body, and thus the length 81 is somewhat larger than flattened width of the hose, shown in broken outline at 14.1.

The latching means 35 for retaining the first and second portions together will now be described. The latching means of the first portion comprises the spindle 30 having an inner end 83 securely retained in the body portion 26, and an outer end having a conical portion 85 and a recessed annular groove 87 spaced inwardly from the conical portion. The latching means of the second portion includes a latching member 89 having a trigger 90 at an outer end for gripping by the finger, and a detent portion 92 at an inner end. The detent portion has a width sufficient to be received in the groove 85 of the spindle, and a spring 94 urges the latching member 89 radially inwardly to force the detent portion into the groove. A cap member 96 fits over the latching member and the conical portion 85 to reduce ingress of dirt, and to ensure generally radial movement of the latching member 89 in direction of a double headed arrow 98 which is perpendicular to the axis 33 and along a radius of the plate 37. Thus, it can be seen that the latching member 89 is a moveable portion of the latching means 35 and is movable generally perpendicularly to the reel axis 33 in a first direction to disengage the latching means, and in an opposite second direction to engage the latching means. In addition, it can be seen that the cap member 96 and related structure serves to retain the movable portion of the latching means, i.e. the member 89. The member 89 is clearly captive on the second portion of the apparatus, i.e. the reel portion 29, to prevent loss, although it could be captive on the first portion with suitable design changes. Thus, it can be seen that the latching member is spring-urged to force the inner end thereof in the second direction towards the fixed portion of the latching means, to engage the fixed portion so as to hold the latching means engaged.

Figure 7:
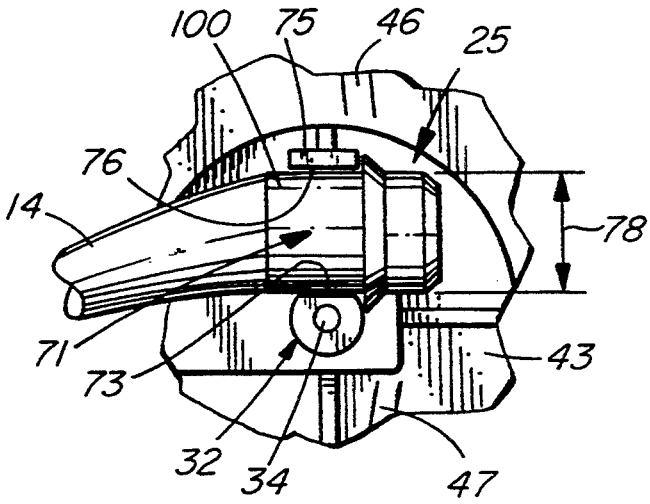
FIG. 7 shows hose end retaining means to retain an inner portion of the hose on the reel.

FIGS. 5, 6 and 7

As seen in FIG. 7, the length of hose 14 has an inner coupling 100 which is retained in the hose end retaining means 71 by passing axially between the surfaces 73 and 76 of the column 32 and the projection 75 which extend from the reel portion 25. The column 32 and projection 75 are shown in broken outline in FIG. 6 only to provide reference for the spindle 30 and the body 26. The surfaces 73 and 76 of the end retaining means 71 are generally parallel to each other, and each face is disposed generally tangentially to a respective surface of revolution centred on the reel axis, the surfaces of revolution not being shown. In FIG. 7, the guiding marks 46 and 47 on the inner face 43 extend generally perpendicularly with respect to a main axis of the coupling 100, so that the band 42 passes transversely across the coupling as will be described.

Referring to FIG. 6, the guide surfaces 67 and 68 of the guide members 64 and 65 of the hose guide means 60 are generally cylindrical to provide a gradual squeezing affect to the hose as it passes in direction of an arrow 102 onto the reel. Water and air are stripped or squeezed from the hose prior to passing around the inner hose coupling 100, the projection 75 and the column 32. The guide retaining bar 70 is hinged to the guide member 64 and is shown in broken outline in an extended position 70.1. This position permits the hose 14 to be passed laterally into the slot 69 between the guide surfaces prior to winding the hose onto the reel, or for removing the hose from the reel when winding is complete. Thus, the guide retaining means is for releasably retaining the hose between the hose guide means and cooperates with the hose guide means to permit insertion and removal of the hose from between the guide surfaces. The guide retaining means thus comprises a hinged arm, namely the bar 70, having an inner end hinged to the member 64, and an outer end releasably and resiliently engageable with the remaining guide member 65. As seen in FIG. 5, the bar 70 is hinged with a hinge pin 104 which is encircled by a spring 106, to resiliently latch the bar 70 with respect to the member 65 using a complementary detent and recess, not shown.

OPERATION

Figure 8:
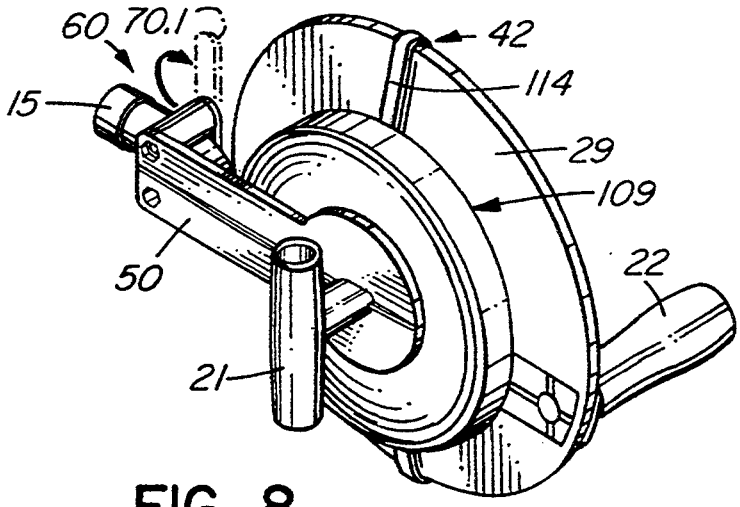
FIG. 8 is a perspective showing a wound-up hose on the reel prior to separation therefrom.

To initiate winding of a loose length of hose 14, the rubber band 42 is passed over the reel portion 29 so that outer looped portions of the band are retained in the recesses 40 and 41 in the periphery, and an intermediate or first length 114 passes along the guiding marks 46 and 47 across the inner face 43 and closely adjacent the column 32, as seen in FIGS. 4 and 8. The inner coupling 100 of the hose is then fitted between the flat surface 73 of the column 32, and the oppositely facing inner surface 76 of the projection 75, as seen in FIG. 6. As seen in FIG. 5, the spindle 30 is then pushed into the opening 34 of the column 32, and the conical portion 85 at the outer end forces the latching member 89 radially outwardly to permit the spindle to pass completely into the opening 34, whereupon the latching member then snaps radially inwardly so that the detent portion 92 is engaged in the groove 85. This locates the first and second portions together, and permits relative rotation therebetween without inadvertent separation. The guide retaining bar 70 is then swung about the guide member 64 to be out of engagement with the adjacent guide member 65, and a short length of hose adjacent the inner coupling 75 then passes laterally into the guide slot 69, as best seen in FIG. 6. The guide retaining bar 70 is then swung back to engage the guide member 65 to retain the hose in the guide slot. The apparatus is now ready for winding in the length of hose.

As seen in FIG. 1, the operator grips the first handle 21 in his left hand 17, and rotates the reel portion by gripping the second handle 22 with the right hand 18, until the outer coupling 15 is drawn tightly against the guide means 60. During this process, to enable the hose to be flattened, any water or air in the hose is stripped or squeezed from the hose by the guide means 60 to pass outwardly through the outer coupling 15. As the hose passes through the guide means 60, it is aligned so as to be flattened to a plane generally parallel with the axis 33. Thus it can be seen that the guide means 60 serves as a hose preparing means for preparing in sequence adjacent portions of the hose for winding onto the reel, prior to winding the hose onto the reel. When the outer coupling 15 touches the guide means 60, the operator continues to rotate the reel portion 29 to sequentially tighten the hose about the inner coupling 100 and the end retaining means 71, and to further squeeze liquid and air from the hose. When a strong resistance to further rotation is felt, the operator stops rotating the handle 22 and swings open the retaining bar 70 to permit a portion of the hose adjacent the outer coupling 15 to be withdrawn from the retaining means. The hose is now in a tightly wound coil 109, which condition is shown in FIG. 8, just prior to withdrawal of the hose from the guide means.

Figure 9:
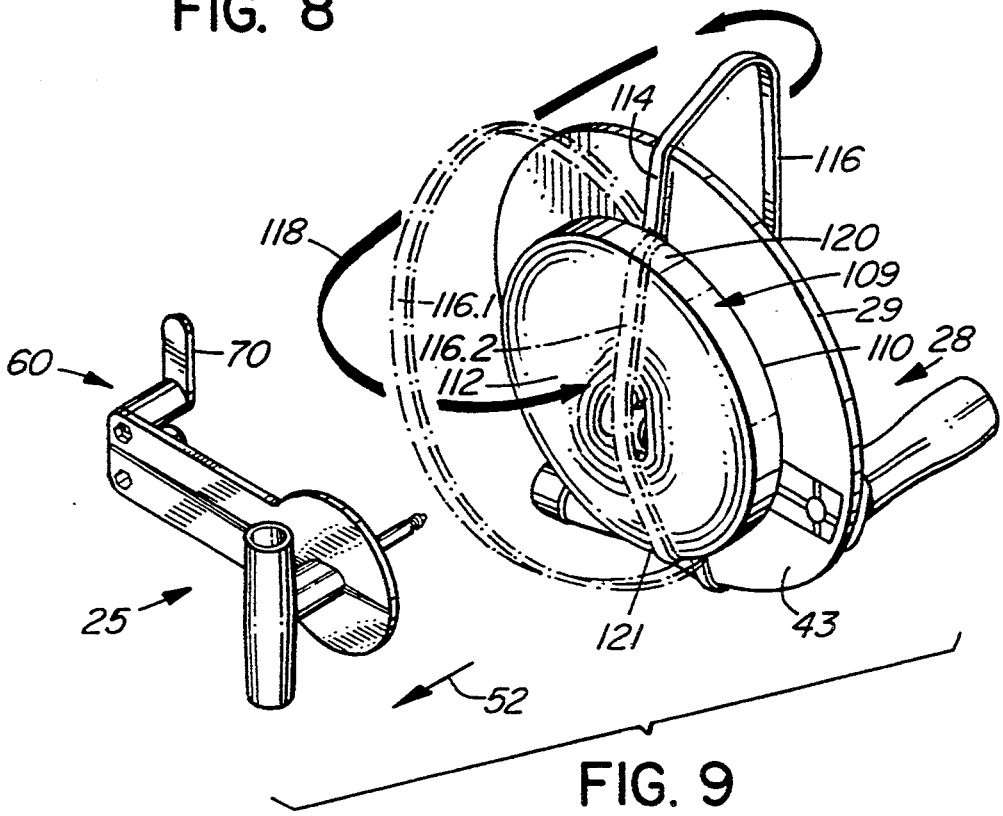
FIG. 9 is a perspective generally similar to FIG. 8, in which a resilient band is shown being stretched and positioned to retain the hose in a wound-up state, after separation of portions of the apparatus.
Figure 10:
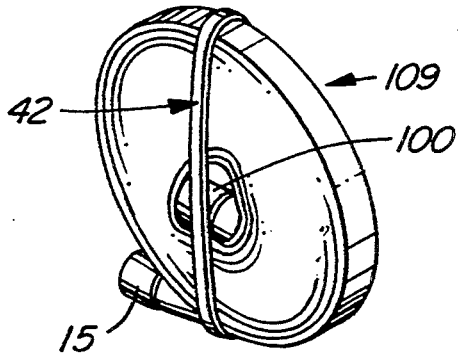
FIG. 10 shows a wound-up coil retained by the band.

The latching means 35 is then released to permit the portions 25 and 28 to separate easily along the axis 33, as shown in FIG. 9, by moving the first portion 25 in a direction of the arrow 52 away from the second portion 28. The tightly wound coil 109 on the reel has opposite first and second faces 110 and 112 respectively. The first face 110 of the reel is against a first length 114 of the band 42, and is also against the inner face 43 of the reel portion 29, and the second face 112 is now exposed.

The operator then draws and stretches a second length 116 of the band from the outer face 44 of the reel portion so that the second length moves in accordance with an arrow 118, through an intermediate position 116.1, until it lies against the second face 112 of the wound-up reel, as shown in broken outline at 116.2 in FIG. 9. In this position, it can be seen that the band embraces and lies closely against the generally flat first and second faces 110 and 112 of the coil 120, and across generally diametrically opposite cylindrical sides of the coil 120 and 121 which are held tightly by the band. The lengths 114 and 116 of the band pass on opposite sides of the inner coupling 100 and thus assist in locating the coupling within the coil. The operator then draws the tightly wound coil 109, together with the inner coupling 100, axially from the reel along the column 32, and the reel is retained wound by the stretched band 42 passing across the first and second faces and the sides 120 and 121 of the reel as seen in FIG. 10.

It can be seen that the use of a reel portion having the single reel plate 37 to receive the hose wound thereagainst and the spacer means, i.e. the column 32, to space the plate axially from the body to receive the wound coil serves as a coil removal means for permitting the wound-up coil of hose 109 to be removed from the reel portion without unwinding the coil. As best seen in FIGS. 4 and 5, the column 32, which also serves as the spacing means, is tapered in a direction away from the reel plate and along the axis of rotation to facilitate removal of the wound-up coil of hose from the reel plate.

When the hose is in the tightly wound coil 109, and is completely separated from the hose winding apparatus 12, it can be carried in an operator's pocket or pack. The coil is packed in a tight form from which it would be unlikely to inadvertently separate into a disorganized tangle as in the prior art. Clearly, many such tightly wound hoses could be stored in this manner, and if necessary additional resilient bands could be provided to pass at different angles to each other around the coil so as to provide a compact package. Thus, the hose is maintained tightly wound by a hose retaining means which comprises a resilient or rubber band 42 having a size to fit across opposite locations on the reel portion. This contrasts with some prior art wound coil retaining means which comprises an adjustable strap or belt which passes peripherally around the cylindrical circumference of the wound hose, as opposed to passing diametrically across the parallel faces of a wound hose. Clearly, the means of fitting the band across the coil of wound hose is relatively fast and simple, and with practice can be performed while wearing heavy work gloves.

This method of retaining a wound-up hose after removal from the reel is considered of major importance and simplifies fitting a rubber or resilient band to extend diametrically across generally opposite locations of the reel portion prior to winding the hose. To summarize the method, the hose is wound onto the reel portion to form a hose coil of tightly wound-up hose having opposite first and second faces, the first face being against the first length of the band, and the second face being exposed when the reel portion is separated from the body. After the said separation, the band is drawn as described to fully enclose the wound-up coil independently of the remaining portion of the apparatus, so as to permit re-use of the apparatus to wind up other lengths of hose, which would only require additional rubber bands.

Thus, only one winding apparatus is required for each operator, and one or more resilient bands are required for each length of hose. The apparatus is compact and lightweight and thus facilitates use in rugged forested terrain where it must be carried. Furthermore, to separate the coil of wound-up hose from the apparatus, the apparatus separates into only two portions with no loose fasteners, which otherwise would likely be lost easily in rough terrain. Clearly, if this device were to be enlarged to accept larger diameter hoses, it would become heavier and may then require a stand to support it when the hose is being wound. While this might lose the original advantage of portability, the advantage of providing a lightly wound hose separate from the apparatus would be retained.

We claim:

1. A portable hose winding apparatus comprising:
(a) a first portion having a body, a first handle for holding the body, and first reel journalling means,
(b) a second portion having a reel portion, a second handle cooperating with the reel portion, and a second reel journalling means complementary to the first reel journalling means for journalling the reel portion for rotation about a reel axis to wind a hose thereon,
(c) latching means for releasably latching together the first and second reel journalling means, the latching means having a movable portion which is movable generally perpendicularly to the reel axis in a first direction to disengage the latching means, so that when the latching means is disengaged, the latching means and the first and second reel journalling means permit axial separation between the reel portion and the body, and the movable portion is moveable in an opposite second direction to engage the latching means, so that when the latching means is engaged, the latching means and the first and second reel journalling means permit relative rotation between the reel portion and the body without inadvertent separation of the first and second portions,
(d) coil removal means for permitting a wound-up coil of hose to be removed from the reel portion without unwinding the coil, by sliding the wound-up coil axially from the reel portion when the reel portion is separated from the body.

2. An apparatus as claimed in claim 1, in which the coil removal means is characterized by:
(a) the reel portion having a single reel plate to receive the hose wound thereagainst; and
(b) spacing means to space the reel plate axially from the body sufficiently to receive the wound-up hose therebetween, the spacing means extending axially from the reel plate to a spacing means outer end which contacts the body, the spacing means having a length somewhat longer than a flattened width of the hose.

3. An apparatus as claimed in claim 2, in which the coil removal means further comprises:
(a) hose end retaining means for releasably retaining an end of the hose, the hose end retaining means cooperating with the spacing means on a side of the reel plate which receives the wound-up coil of hose.

4. An apparatus as claimed in claim 3, in which:
(a) the hose end retaining means comprises an inner portion and an outer portion having oppositely disposed faces spaced apart to receive a hose coupling therebetween, the inner portion serving as the said spacing means which has the spacing means outer end which contacts the body.

5. An apparatus as claimed in claim 4, in which:
(a) the faces of the hose end retaining means are generally parallel to each other and disposed generally tangentially to a surface of revolution centred on the reel axis, the hose end retaining means extending from the reel plate in a first direction,
(b) the second handle extends from the reel plate in a second direction, which is opposite to the first direction of the end retaining means.

6. An apparatus as claimed in claim 3, in which the coil removal means further comprises:
(a) the spacing means being adapted to receive the wound-up coil of hose thereon.

7. An apparatus as claimed in claim 6, in which the coil removal means further comprises:
(a) the spacing means being tapered in a direction away from the reel plate to facilitate removal of the wound-up coil of hose from the plate.

8. An apparatus as claimed in claim 1, further comprising:
(a) wound hose coil retaining means for retaining the hose coil in a wound-up state when released from the apparatus.

9. An apparatus as claimed in claim 8, in which:
(a) the wound hose coil retaining means comprises a resilient band having a size to fit across opposite locations of the reel portion.

10. An apparatus as claimed in claim 9, in which:
(a) the reel portion is a generally flat reel plate with a circular rim centred on the reel axis, the rim having a pair of generally diametrically spaced recesses to receive the resilient band,
(b) the resilient band extends between the recesses and generally across a diameter of the reel plate.

11. An apparatus as claimed in claim 1, further comprising:
(a) a hose preparing means for preparing in sequence adjacent portions of the hose for winding onto the reel portion, prior to winding the hose onto the reel portions, the hose preparing means cooperating with the first portion.

12. An apparatus as claimed in claim 11, in which:
(a) the hose preparing means comprises a hose guide means having a pair of oppositely disposed guide surfaces facing each other and defining a slot therebetween, the slot being generally parallel to the reel axis so as to align the hose for winding onto the reel,
(b) guide retaining means for releasably retaining the hose between the hose guide means, the guide retaining means cooperating with the hose guide means to permit insertion and removal of the hose from between the guide surfaces.

13. An apparatus as claimed in claim 12, in which:
(a) the body has a guide arm extending therefrom a distance greater than radius of the reel portion, and the first handle extends in a first direction from the guide arm,
(b) the hose guide means comprising a pair of spaced apart guide members extending from an outer end of the guide arm in a second direction which is opposite to the first direction of the first handle, the guide members having the guide surfaces, (c) the guide retaining means comprises a hinged arm having an inner end hinged to one guide member and an outer end releasably engageable with the remaining guide member.

14. An apparatus as claimed in claim 1 in which:

(a) the movable portion of the latching means is captive on either the first portion or the second portion and comprises a latching member having inner and outer ends, the outer end being contactable by an operator for moving the latching member generally radially with respect to the journalling means, and (b) the latching means has a fixed portion which is complementary to the inner end of the latching member to cooperate with the inner end of the latching member when the latching means is engaged to prevent essentially axial movement of the reel portion with respect to the body.

15. An apparatus as claimed in claim 14 in which:

(a) the latching member is mounted for radial movement on the reel portion, the outer end of the latching member has a trigger for gripping, and the inner end of the latching member has a detent portion, and (b) the first reel journalling means is a spindle extending from the first handle, and the fixed portion of the latching means comprises an annular groove in the spindle to receive the detent portion of the latching member when the latching means is engaged.

16. An apparatus as claimed in claim 14, in which:

(a) the latching member is spring-urged to force the inner end thereof towards the fixed portion of the latching means to engage the fixed portion so as to hold the latching means engaged.

17. An apparatus as claimed in claim 1, in which:

(a) the moveable portion of the latching member is spring-urged to move in the second direction to hold the latching means engaged.

18. A method of removing a tightly wound-up hose coil from a reel of an apparatus, the method including the steps of:

(a) fitting a resilient endless band to extend across generally opposite locations on a rim of a reel portion of the apparatus, so that first and second lengths of the band extend across opposite inner and outer faces of the reel portion, (b) rotating the reel portion with respect to a body of the apparatus to wind the hose onto the reel portion to form the tightly wound-up hose coil, the tightly wound-up hose coil having oppositely facing first and second faces in which the first face of the wound-up hose coil is adjacent the inner face of the reel portion and the first length of the band, and the second face is adjacent the body, (c) drawing and stretching the second length of the band from the reel, and positioning the second length of the band closely against the second face of the hose coil, and generally diametrically opposite sides of the coil are retained tightly by the band, and (d) drawing the wound-up hose coil from the reel portion along an axis of rotation of the reel portion, the hose coil being retained wound-up by the stretched resilient band extending across the wound-up hose coil.

19. A method as claimed in claim 18, in which:

(a) subsequent to winding the hose onto the reel, separating the body from the reel portion so as to expose the second face of the wound-up hose coil, and (b) removing the second length of the band from the outer face of the reel portion to extend across the second face of the wound-up hose coil.

20. A method as claimed in claim 19, further characterised by:

(a) exposing the second face of the wound-up hose by disengaging a latching means which permits axial separation of the wound-up hose from a body and handle which journal the reel portion for winding the hose.

21. A method as claimed in claim 20, further characterized by:

(a) disengaging the latching means by moving a moveable portion of the latching means against a spring force which holds the moveable portion of the latching means engaged with a fixed portion of the latching means.

* * * * *